US007959234B2

(12) United States Patent
Cameron et al.

(10) Patent No.: US 7,959,234 B2
(45) Date of Patent: Jun. 14, 2011

(54) ROTATABLE CUTTING TOOL WITH SUPERHARD CUTTING MEMBER

(75) Inventors: Vernon B. Cameron, Greensburg, PA (US); Don C. Rowlett, Bedford, PA (US); Randall W. Ojanen, Bristol, TN (US)

(73) Assignee: Kennametal Inc., Latrobe, PA (US)

( * ) Notice: Subject to any disclaimer, the term of this patent is extended or adjusted under 35 U.S.C. 154(b) by 202 days.

(21) Appl. No.: 12/397,472

(22) Filed: Mar. 4, 2009

(65) Prior Publication Data

US 2010/0052407 A1 Mar. 4, 2010

Related U.S. Application Data

(60) Provisional application No. 61/069,440, filed on Mar. 15, 2008.

(51) Int. Cl.
*E21C 35/183* (2006.01)

(52) U.S. Cl. ..... 299/105; 299/113; 299/111

(58) Field of Classification Search ..... 299/105, 299/106, 107, 110, 111, 113
See application file for complete search history.

(56) References Cited

U.S. PATENT DOCUMENTS

| | | | | |
|---|---|---|---|---|
| 3,519,309 | A | | 7/1970 | Engle et al. |
| 3,752,515 | A | | 8/1973 | Oaks et al. |
| 4,063,909 | A | | 12/1977 | Mitchell |
| 4,201,421 | A | | 5/1980 | Den Besten et al. |
| 4,389,074 | A | | 6/1983 | Greenfield |
| 4,497,520 | A | | 2/1985 | Ojanen |
| 4,604,106 | A | | 8/1986 | Hall et al. |
| 4,694,918 | A | | 9/1987 | Hall |
| 4,811,801 | A | | 3/1989 | Salesky et al. |
| 4,859,543 | A | | 8/1989 | Greenfield et al. |
| 4,886,710 | A | | 12/1989 | Greenfield |
| 4,981,328 | A | | 1/1991 | Stiffler et al. |
| 5,008,073 | A | | 4/1991 | Greenfield |
| 5,112,411 | A | | 5/1992 | Greenfield |
| 5,131,725 | A | | 7/1992 | Rowlett et al. |
| 5,161,627 | A | * | 11/1992 | Burkett ..... 299/111 |
| 5,219,209 | A | | 6/1993 | Prizzi et al. |
| 5,261,499 | A | | 11/1993 | Grubb |

(Continued)

OTHER PUBLICATIONS

Notification of Transmittal of the International Search Report and Written Opinion of the International Searching Authority for PCT/US2009/037050 mailed Oct. 20, 2009 (4 pages).

(Continued)

*Primary Examiner* — Frederick L Lagman
(74) *Attorney, Agent, or Firm* — Matthew W. Smith

(57) ABSTRACT

A rotatable cutting tool that is useful for impingement upon a substrate and is adapted to be rotatably retained within the bore of a holder. The rotatable cutting tool includes an elongate cutting tool body, which has an axial forward end and an axial rearward end, as well as a socket at the axial forward end thereof. The rotatable cutting tool also includes a hard cutting member that is affixed to the cutting tool body within the socket. The hard cutting member has an axial forward end and an axial rearward end. The hard cutting member has a superhard axial forward portion at the axial forward end thereof wherein the superhard axial forward portion has a maximum transverse dimension. The hard cutting member further has a hard axial rearward portion contiguous with and axial rearward of the superhard axial forward portion. The hard axial rearward portion has a maximum transverse dimension. The ratio of the maximum transverse dimension of the superhard axial forward portion to the maximum transverse dimension of the hard axial rearward portion ranges between about 0.35 and about 0.45.

6 Claims, 6 Drawing Sheets

U.S. PATENT DOCUMENTS

| | | | | |
|---|---|---|---|---|
| 5,429,199 | A | 7/1995 | Sheirer et al. | |
| 5,823,632 | A | 10/1998 | Burkett | |
| 6,051,079 | A | 4/2000 | Andersson et al. | |
| 6,197,084 | B1 | 3/2001 | Liang | |
| 6,375,272 | B1 | 4/2002 | Ojanen | |
| 6,478,383 | B1 | 11/2002 | Ojanen et al. | |
| 7,320,505 | B1 * | 1/2008 | Hall et al. | 299/111 |
| 7,380,888 | B2 | 6/2008 | Ojanen | |
| 7,384,105 | B2 | 6/2008 | Hall et al. | |
| 7,445,294 | B2 * | 11/2008 | Hall et al. | 299/111 |
| 2003/0209366 | A1 | 11/2003 | McAlvain | |
| 2004/0026983 | A1 * | 2/2004 | McAlvain | 299/111 |
| 2007/0290546 | A1 | 12/2007 | Hall et al. | |
| 2008/0036278 | A1 * | 2/2008 | Hall et al. | 299/105 |
| 2008/0099249 | A1 * | 5/2008 | Hall et al. | 299/111 |
| 2008/0169698 | A1 * | 7/2008 | Hall et al. | 299/113 |
| 2009/0051211 | A1 * | 2/2009 | Hall et al. | 299/105 |
| 2009/0133938 | A1 * | 5/2009 | Hall et al. | 299/111 |
| 2009/0273224 | A1 * | 11/2009 | Hall | 299/113 |
| 2009/0273225 | A1 * | 11/2009 | Hall et al. | 299/113 |

OTHER PUBLICATIONS

International Search Report for PCT/US2009/037050 mailed Oct. 20, 2009 (4 pages).

Written Opinion of the International Searching Authority for PCT/US2009/037050 mailed Oct. 20, 2009 (5 pages).

* cited by examiner

ROTATABLE CUTTING TOOL WITH SUPERHARD CUTTING MEMBER

REFERENCE TO EARLIER RELATED PATENT APPLICATION

This patent application is based upon pending U.S. Provisional Patent Application Ser. No. 61/069,440 filed on Mar. 15, 2008 for a ROTATABLE CUTTING TOOL WITH SUPERHARD CUTTING MEMBER wherein the inventors are Vernon C. Cameron, Don C. Rowlett, and Randall W. Ojanen, and applicants hereby claim priority on said U.S. Provisional Patent Application Ser. No. 61/069,440 filed on Mar. 15, 2008 for a ROTATABLE CUTTING TOOL WITH SUPERHARD CUTTING MEMBER. Further, the entire disclosure of the above co-pending provisional U.S. Provisional Patent Application Ser. No. 61/069,440 filed on Mar. 15, 2008 is hereby incorporated by reference herein in its entirety.

BACKGROUND OF THE INVENTION

The invention pertains to a rotatable cutting tool, which typically mounts in a stationary block (or holder) on a rotatable drum. The rotatable cutting tool engages or impinges a substrate upon the rotation of the drum. More specifically, the invention pertains to the aforementioned type of rotatable cutting tool wherein the rotatable cutting tool, which is rotatable about its central longitudinal axis, carries a superhard cutting member at the axially forward end thereof. The super hard cutting member is made from a superhard material (or includes a portion there of made from a superhard material). Superhard materials useful in the present invention include, without limitation, materials like polycrystalline diamond (PCD) or polycrystalline cubic boron nitride (PcBN).

A rotatable cutting tool typically presents a generally elongate, cylindrical geometry. The rotatable cutting tool comprises an elongate steel cutting tool body, which has an axially forward end and an opposite axially rearward end. The cutting tool body typically carries an assembly or means by which the rotatable cutting tool is rotatable carried by the stationary block or holder on the drum. Exemplary structures useful for the rotatable attachment of a rotatable cutting tool to a block or holder include those shown and described in U.S. Pat. No. 4,201,421 to Den Besten et al., U.S. Pat. No. 3,519,309 to Engle et al., U.S. Pat. No. 3,752,515 to Oaks et al., and U.S. Patent Application Publication No. US 2002/0153175 to Ojanen for a Rotatable Cutting Tool having Retainer with Dimples.

A hard cutting member typically affixes, such as by brazing, to the axial forward and of the cutting tool body. Heretofore, a hard cutting member suitable for use in a rotatable cutting tools have exhibited many different geometries. One exemplary geometry is shown and described in U.S. Pat. No. 4,497,520 to Ojanen.

Typically, the hard cutting member is made from a hard material like cemented cobalt tungsten carbide. The following patent documents disclose exemplary compositions of hard material suitable for use as a hard cutting member in a rotatable cutting tool. Further, the following patent documents disclose the use of diamond materials in the context of a rotatable cutting tool: U.S. Pat. No. 6,051,079 to Andersson et al., U.S. Patent Application Publication No. US2004/0026983 to McAlvain, and U.S. Patent Application Publication No. US2003/0209366 to McAlvain. In reference to brazing the hard cutting member to the cutting tool body, U.S. Pat. No. 4,389,074 to Greenfield, U.S. Pat. No. 5,131,725 to Rowlett et al., U.S. Pat. No. 5,429,199 to Sheirer et al., U.S. Pat. No. 6,375,272 to Ojanen, and U.S. Pat. No. 6,478,383 to Ojanen et al. discloses braze alloys that have heretofore been suitable for such a brazing operation.

In the case of a road planing machine, the rotatable drum can in many cases carry hundreds of individual blocks or holders. Each individual block or holder carries its own corresponding rotatable cutting tool, which is rotatable relative to its corresponding block or holder. It is not unusual that a rotatable drum will carry hundreds of individual rotatable cutting tools.

The road planing machine powers the rotatable drum so as to cause it to rotate. The orientation of the rotatable cutting tools with respect to the drum is such so that upon rotation of the drum, the drum drives the rotatable cutting tools into the substrate. Upon the rotatable cutting tools impinging the substrate, the substrate typically breaks thereby forming larger chunks of debris, as well as smaller particles and pieces of debris. Typically, the debris generated in a road planing operation is highly abrasive which causes the rotatable cutting tool to experience wear.

The rotatable cutting tool can experience wear in a number of ways. The hard cutting member, which is the portion of the rotatable cutting bit that first impinges the substrate, can experience wear. The initial impact of the hard cutting member against the substrate, as well as the travel of the debris along the hard cutting member, can cause this wear. Over the course of the cutting operation, the hard cutting member can lose material to the point where it becomes dull and ineffective to accomplish efficient cutting.

Another wear mechanism pertains to the braze joint between the hard cutting member and the elongate cutting tool body. Throughout the course of the cutting operation, the braze joint experiences severe stresses due to the continual intermittent violent impingement of the rotatable cutting tool against the substrate material. Over the course of time, the braze joint can experience sufficient stress so as to fail thereby allowing the hard cutting member to separate from the cutting tool body. Obviously, if the rotatable cutting tool loses the hard cutting member, the rotatable cutting tool is no longer useful for the cutting operation.

Further, during a cutting operation such as, for example, a road planing operation, debris travels down the elongate cutting tool body. Due to the abrasive nature of the debris, the elongate cutting tool body experiences wear and erosion. Since the cutting tool body typically comprises steel, those in the pertinent art characterize this wear phenomenon as "steel wash". The result of "steel wash" is to cause the axial forward portion of the cutting tool body beneath or axially behind the hard cutting member to reduce in diameter. Such a reduction in diameter causes this portion of the cutting tool body to take on an hourglass shape. As the cutting operation continues, the axial forward portion of the cutting tool body continues to reduce in diameter to a point where it eventually breaks thereby ending the useful life of the rotatable cutting tool due to the failure of the cutting tool body.

As one can appreciate from the above description, there are a number of ways in which the rotatable cutting tool can lose its effectiveness to provide for efficient cutting. As mentioned above, it is not unusual that a rotatable drum will carry hundreds of individual rotatable cutting tools. Thus, if only a small number of rotatable cutting tools lose their cutting efficiency, the rotatable drum may continue to cut in an efficient fashion. When this is the case, the need to replace worn or failed rotatable cutting tools may not be great or at least it may not be mandatory. However, as the number of rotatable cutting tools which lose their cutting efficiency increases, the overall cutting efficiency of the rotatable drum decreases.

Eventually, the cutting efficiency of the rotatable drum reaches a level that requires the operator to change the rotatable cutting tools, i.e. typically substitute new rotatable cutting tools for inoperable rotatable cutting tools.

Because of the difficulty typically inherent in removing and installing rotatable cutting tools, as well as the great number of rotatable cutting tools typically carried by a rotatable drum, the road planing machine may have to be taken out of operation for a significant amount of time. Obviously, the overall operating efficiency decreases as the amount of downtime for the road planing machine increases.

It would thus be highly desirable to provide an improved rotatable cutting tool, which is rotatably carried by an individual block or holder of a rotatable drum of a cutting machine (e.g., a road planing machine), that experiences an increase, and especially a significant increase, in useful tool life as compared to heretofore known rotatable cutting tools.

Further, it would be highly desirable to provide such an improved rotatable cutting tool that has a hard cutting member wherein the hard cutting member maintains its integrity longer than hard cutting members in heretofore known rotatable cutting tools. This will result in an increase in useful life of the rotatable cutting tool as compared to heretofore known rotatable cutting tools.

In addition, it would be highly desirable to provide such an improved rotatable cutting tool that presents a braze joint that maintains its integrity longer than braze joints in heretofore known rotatable cutting tools. This will result in an increase in useful life of the rotatable cutting tool as compared to heretofore known rotatable cutting tools.

Furthermore, it would be highly desirable to provide such an improved rotatable cutting tool that presents a cutting tool body that experiences less "steel wash" as compared to heretofore known rotatable cutting tools. By providing a cutting tool body that experiences less "steel wash", there will be an increase in the useful life of the rotatable cutting tool as compared to heretofore known rotatable cutting tools.

SUMMARY OF THE INVENTION

In one form thereof, the invention is a rotatable cutting tool that is useful for impingement upon a substrate and is adapted to be rotatably retained within the bore of a holder. The rotatable cutting tool includes an elongate cutting tool body, which has an axial forward end and an axial rearward end, as well as a socket at the axial forward end thereof. The rotatable cutting tool also includes a hard cutting member that is affixed to the cutting tool body within the socket. The hard cutting member has an axial forward end and an axial rearward end. The hard cutting member has a superhard axial forward portion at the axial forward end thereof wherein the superhard axial forward portion has a maximum transverse dimension. The hard cutting member further has a hard axial rearward portion contiguous with and axial rearward of the superhard axial forward portion. The hard axial rearward portion has a maximum transverse dimension. The ratio of the maximum transverse dimension of the superhard axial forward portion to the maximum transverse dimension of the hard axial rearward portion ranges between about 0.35 and about 0.45.

In another form thereof, the invention is a rotatable cutting tool for impingement upon a substrate and adapted to be rotatably retained within the bore of a holder. The rotatable cutting tool comprises an elongate cutting tool body that has an axial forward end and an axial rearward end. The cutting tool body contains a socket at the axial forward end thereof. A hard cutting member is affixed to the cutting tool body within the socket. The hard cutting member has an axial forward end and an axial rearward end. The hard cutting member has an axial length. The hard cutting member has a superhard axial forward portion at the axial forward end thereof wherein the superhard axial forward portion has a maximum transverse dimension. The hard cutting member further has a hard axial rearward portion contiguous with and axial rearward of the superhard axial forward portion. The hard axial rearward portion has a maximum transverse dimension. The ratio of the maximum transverse dimension of the hard axial rearward portion to the axial length of the hard cutting member ranges between about 0.75 and about 0.85.

BRIEF DESCRIPTION OF THE DRAWINGS

The following is a brief description of the drawings that form a part of this patent application.

DETAILED DESCRIPTION OF SPECIFIC EMBODIMENTS

Figure 1:
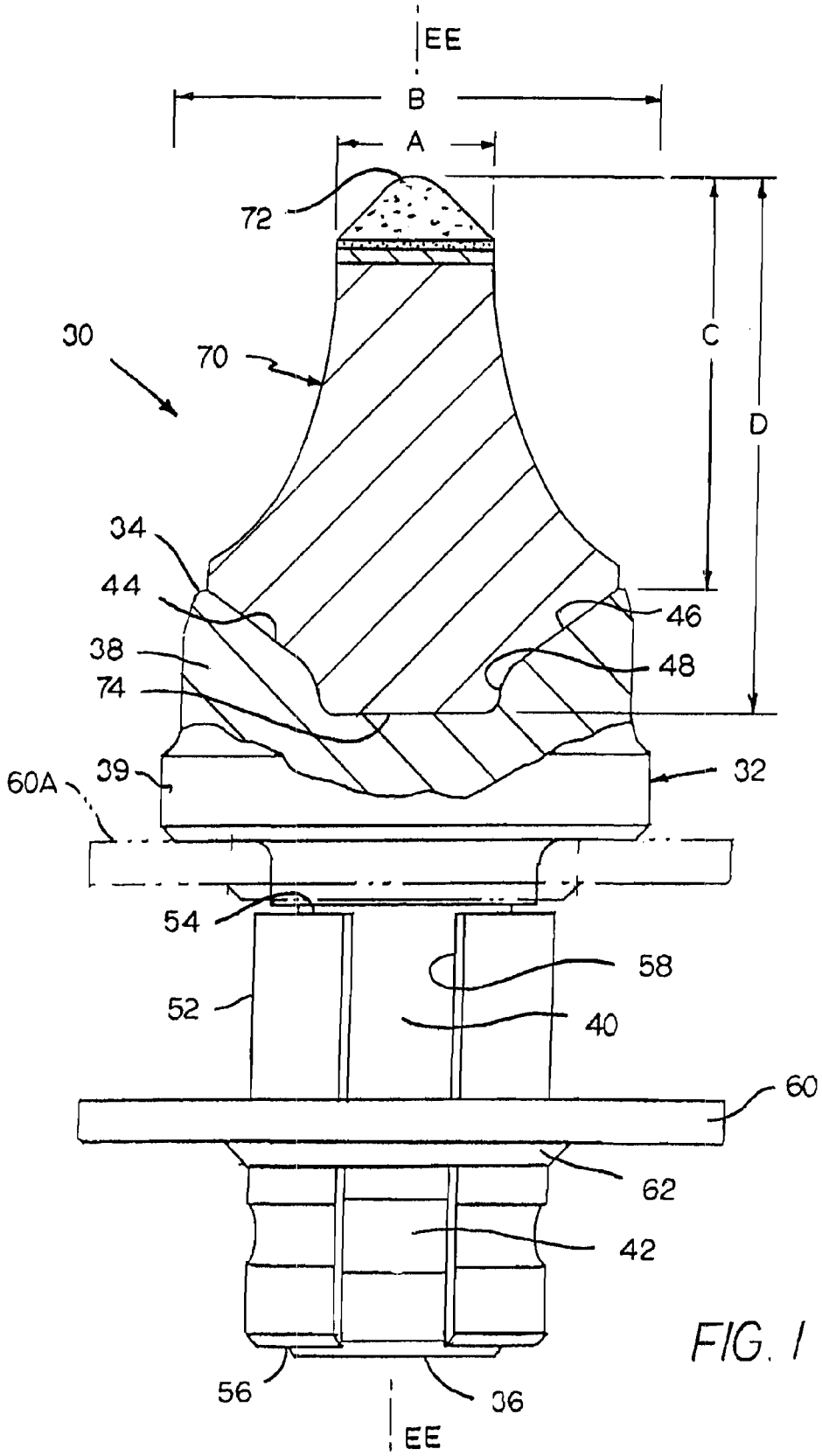
FIG. 1 is a side view of a first specific embodiment of a rotatable cutting tool of the invention wherein the hard cutting member, as well as an axially forward portion of the cutting tool body, are illustrated in cross-section to illustrate the geometry of the entire hard cutting member and of the braze joint between the hard cutting member and the cutting tool body.
Figure 2:
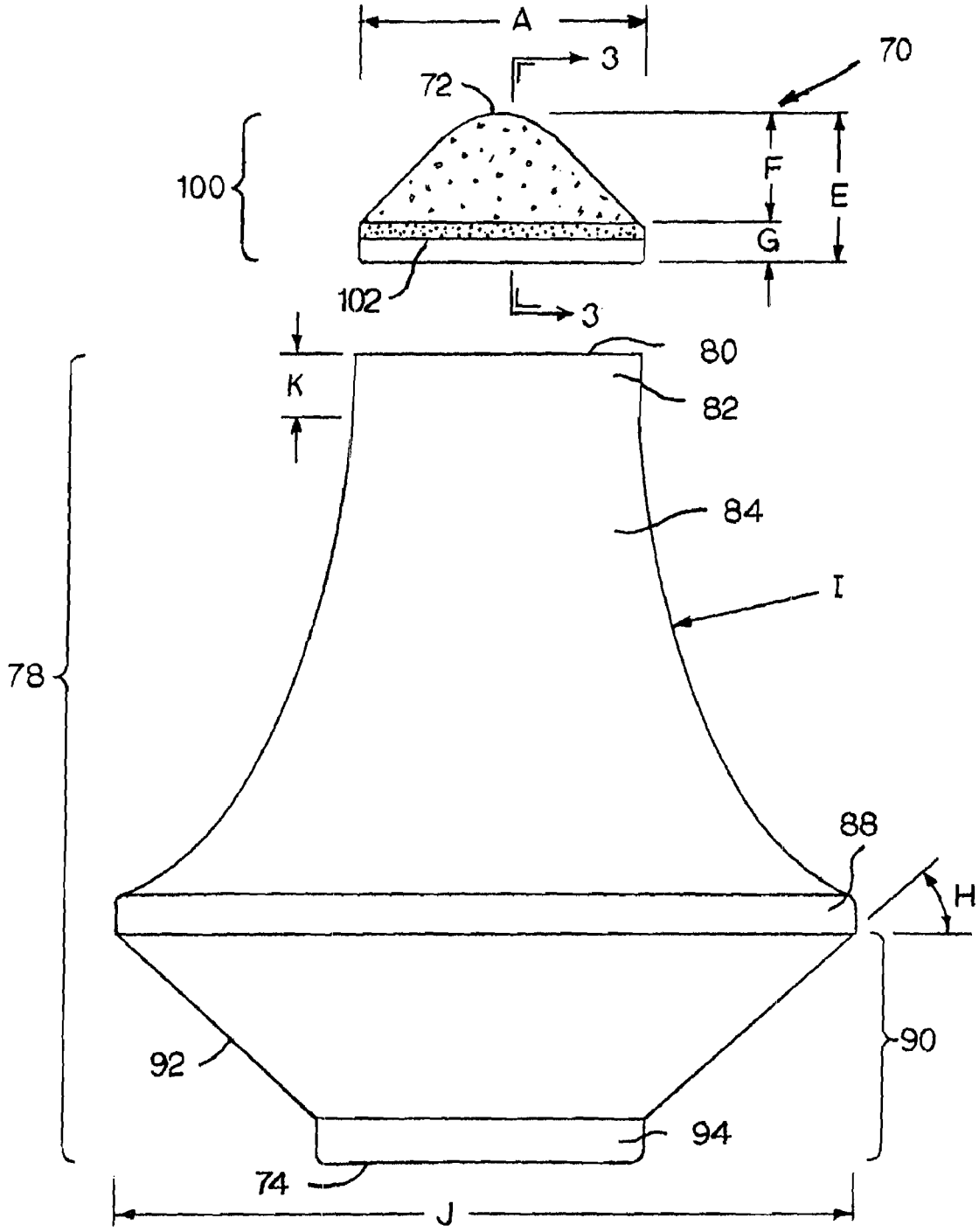
FIG. 2 is a side view of the hard cutting member of FIG. 1 wherein the superhard axial forward portion of the hard cutting member is exploded from the hard axial rearward portion of the hard cutting member.
Figure 3:
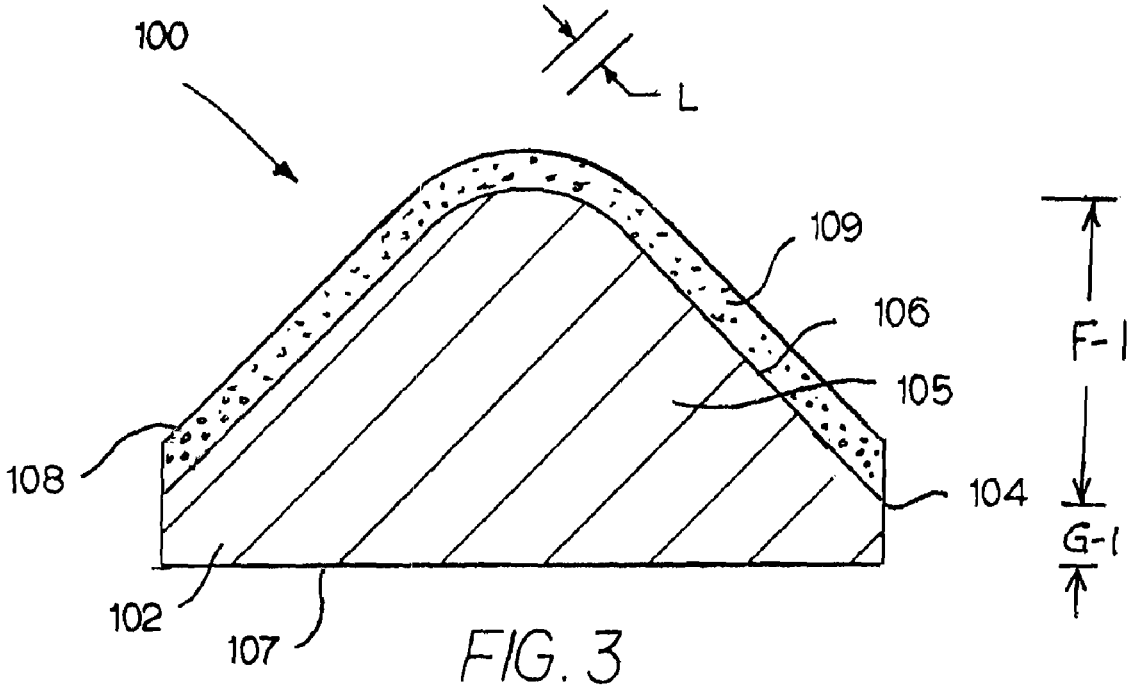
FIG. 3 is a cross-sectional view taken a long section line 3-3 of FIG. 2 showing the layer of polycrystalline diamond (i.e., a superhard material) affixed to the axially forward surface of the superhard axial forward portion of the hard cutting member.

Referring to the drawings, FIGS. 1-3 illustrate a first specific embodiment of the rotatable cutting tool of the invention, generally designated as 30. The specific embodiments illustrated herein pertain to road planing tools. However, one should appreciate that the invention has application to other kinds of cutting tool useful in other kinds of cutting operations. Exemplary operations include without limitation road planing (or milling), coal mining, concrete cutting, and other kinds of cutting operations wherein a cutting tool with a hard cutting member impinges against a substrate (e.g., earth strata, pavement, asphaltic highway material, concrete, and the like) breaking the substrate into pieces of a variety of sizes including larger-size pieces or chunks and smaller-sized pieces including dust-like particles.

Rotatable cutting tool 30 has a central longitudinal axis E-E. In operation, rotatable cutting tool 30 rotates about the axis E-E. Rotatable cutting tool 30 includes an elongate cutting tool body generally designated as 32, which typically is made of steel. Exemplary compositions of the steel for the cutting tool body include without limitation those disclosed in the following document: U.S. Pat. No. 4,886,710 to Greenfield, and U.S. Pat. No. 5,008,073 to Greenfield. Elongate cutting tool body 32 presents a generally cylindrical geometry, and has an axial forward end 34 and an axial rearward end 36.

Elongate cutting tool body 32 includes a head portion 38, which has an enlarged transverse dimension adjacent the axial forward end 34 relative to the overall transverse dimension of the cutting tool body. The maximum diameter of the enlarged head portion 38, which is at the collar 39, is dimension "B". The elongate cutting tool body 32 further includes an integral shank portion 40, which has a reduced transverse dimension, adjacent the axial rearward end 36 relative to the overall transverse dimension of the cutting tool body. The shank portion 40 contains an annular groove adjacent the axial rearward end 36. The head portion 38 contains a socket 44 at the axial forward end of the cutting tool body 32. The socket 44 includes a frusto-conical portion 46 and a cylindrical portion 48. The socket 44 further contains a bottom surface. One should appreciate that other geometries of a socket may be suitable for use with the rotatable cutting tool provided that the geometry of the hard cutting member corresponds to that of the socket.

The elongate cutting tool body 32 carries an elongate resilient retainer 52. Resilient retainer 52 presents an axial forward end 54 and an axial rearward and 56. Resilient retainer 52 contains a longitudinal slit 58 along the entire longitudinal length thereof. The presence of the slit 58 provides a radial resiliency to the resilient retainer 52. Although not directly shown, retainer 52 includes a radially inward projection that is received within the groove 42 so as to assist with the retention of the retainer on the shank of the rotatable cutting tool.

A generally circular washer 60 (see solid line illustration), which has a collar 62 extending in an axial rearward direction, surrounds and radially compresses the resilient retainer 52. Although not illustrated, washer 60 contains a central aperture. Washer 60 as illustrated by solid lines is in a condition prior to the insertion of the rotatable cutting tool 30 into the bore of a block or holder. Upon the insertion of the rotatable cutting tool 30 into the bore of a block or holder, the washer 60 is forced in an axial forward direction along the surface of the resilient retainer 52 until it abuts against the rearward surface of the enlarged head portion 38. When in this condition, washer is illustrated as 60A in FIG. 1 by dashed lines.

Rotatable cutting tool 30 further includes a hard cutting member generally designated as 70 affixed by brazing within socket 44 at the axial forward end 34 of the cutting tool body 32. Dimension C represents the axial length of hard cutting member 70 axially forward of the base region 90 when the hard cutting member is affixed within the socket 44 of the cutting tool body 32. Dimension D represents the overall axial length of the hard cutting member 70. One should appreciate that, as one alternative, the entire axial forward end (or surface) 34 may be covered by the hard cutting member. As another option, only a portion of the axial forward and 34 may be covered by the hard cutting member so that at least some portion of the axial forward end 34 is exposed.

Referring especially to FIG. 2, hard cutting member 70 includes an axial forward end 72 and an axial rearward end 74. Hard cutting member 70 includes a hard axial rearward portion shown by bracket 78. The hard axial rearward portion 78 includes an axial forward face 80 (which has a generally cylindrical geometry), as well as a cylindrical region 82, which is contiguous with a concave region 84. Cylindrical region 82 has an axial length of dimension "K". Concave region 84, which has a radius of curvature "I", is contiguous with an axial rearward cylindrical region 88, which is, in turn, contiguous with a base region as shown by bracket 90. Axial rearward cylindrical region 88 has a maximum diameter of a dimension "J". The base portion 90 includes a frusto-conical portion 92, which has an angle of inclination "H", and a contiguous cylindrical portion 94. Hard axial rearward portion 78 typically is made from a hard material such as, for example, cemented (cobalt) tungsten carbide. Grades of cemented (cobalt) tungsten carbide suitable for use herein include those disclosed in U.S. Pat. No. 4,859,543 to Greenfield and U.S. Pat. No. 6,197,084 to Smith.

The hard cutting member 70 up further includes at the axial forward end thereof a superhard axial forward portion as show by bracket 100, which has a maximum diameter (or transverse dimension) of a dimension "A" and an overall axial length of dimension "E". Referring especially to FIGS. 2 and 3, superhard axial forward portion 100 includes a substrate 102, which presents a cylindrical base portion 104, which has an axial length of dimension "G-1" (see FIG. 3), and a conical portion 105, which has an axial length of dimension "F-1" (see FIG. 3). The conical portion 105 presents a generally conical surface 106. The cylindrical base portion 104 presents an axial rearward surface 107. Substrate 102 typically is made from a hard material such as, for example, cemented (cobalt) tungsten carbide. Grades of cemented (cobalt) tungsten carbide suitable for use herein include those disclosed in one or more of the following patent documents, which pertain to a compact of a superhard material and a carbide (or cemented carbide) substrate: U.S. Pat. No. 4,063,909 to Mitchell, U.S. Pat. No. 4,604,106 to Hall et al., U.S. Pat. No. 4,694,918 to Hall, and U.S. Pat. No. 4,811,801 to Salesky et al. One would expect that the grades of cemented carbides disclosed in U.S. Pat. No. 4,859,543 to Greenfield and U.S. Pat. No. 6,197,084 to Smith to be suitable for use as the substrate.

The grade of cemented (cobalt) tungsten carbide suitable for use as substrate 102 may or may not be the same as the grade of cemented (cobalt) tungsten carbide suitable for use as the hard axial rearward portion 78. The specific application for the rotatable cutting tool may dictate the specific grades of cemented (cobalt) tungsten carbide suitable for use therein. In other words, the composition of the substrate 102 may or may not be the same as the composition of the hard axial rearward portion 78.

Superhard axial forward portion 100 further includes a layer of polycrystalline diamond 109, which presents a surface 108, on the conical surface 106. The layer of polycrystalline diamond 109 is of a generally constant thickness "L" (see FIG. 3). In reference to the dimensions of the overall superhard axial forward portion 100, the axial dimension of the cylindrical section is "G" (see FIG. 2) and the dimension of the conical section is "F" (see FIG. 2).

One can apply the layer of polycrystalline diamond 109 to the substrate 102 by any one of a number of techniques wherein the polycrystalline diamond layer is bonded to the surface of the substrate 102. The following patent documents disclose exemplary compositions of polycrystalline diamond as well as exemplary techniques to apply a layer of polycrystalline diamond to the surface of a substrate: U.S. Pat. No. 4,063,909 to Mitchell, U.S. Pat. No. 4,604,106 to Hall et al., U.S. Pat. No. 4,694,918 to Hall, and U.S. Pat. No. 4,811,801 to Salesky et al.

Table I below sets forth the dimensions of the specific embodiment of the rotatable cutting tool 30. By presenting these dimensions, there is no intention to limit the scope of the invention as defined by the claims herein.

TABLE I

Dimensions for the First Specific Embodiment of the Rotatable Cutting Bit 30

| Dimension | Description of dimension | Value (inches unless otherwise noted) |
|---|---|---|
| A | Maximum diameter of superhard axial forward portion 100 | 0.425 |
| B | Maximum diameter of enlarged head portion 38 | 1.39 inches at collar 32 (1.25 inches at element 38) |
| C | Axial length of hard cutting member 70 axially forward of the base region 90 | 1.10 |
| D | Entire axial length of hard cutting member 70 | 1.38 |
| E | Entire axial length of superhard axial forward portion 100 | 0.25 |
| F | Axial length of frusto-conical portion 105 | 0.13 |
| G | Axial length of cylindrical base portion 104 | 0.12 (dimension G-1 is equal to 0.05 inches for the carbide and dimension F-2 is equal to 0.07 inches for the diamond) |
| H | Angle of frusto-conical surface 92 | 30 degrees |
| I | Radius of curvature of concave region 84 | 0.57 |
| J | Maximum diameter of axial rearward cylindrical region 88 | 1.14 |
| K | Axial length of cylindrical region 82 | 0.05 |
| L | Thickness of polycrystalline diamond layer 109 | 0.06 |

There should be an appreciation that the ratio of the maximum diameter of the superhard axial forward portion 100 (dimension "A") to the maximum diameter of the rearward cylindrical portion (dimension "J") (i.e., the ration A/J) should be less than about 0.45 and more preferably less than about 0.40. Further, there should be an appreciation that the ratio of the axial length of hard cutting member 70 axially forward of the base region 90 (dimension "C") to the maximum diameter of the rearward cylindrical portion (dimension "J") (i.e., the ratio C/J) should be less than about 0.80, and more preferably less than about 0.65.

Figure 4:
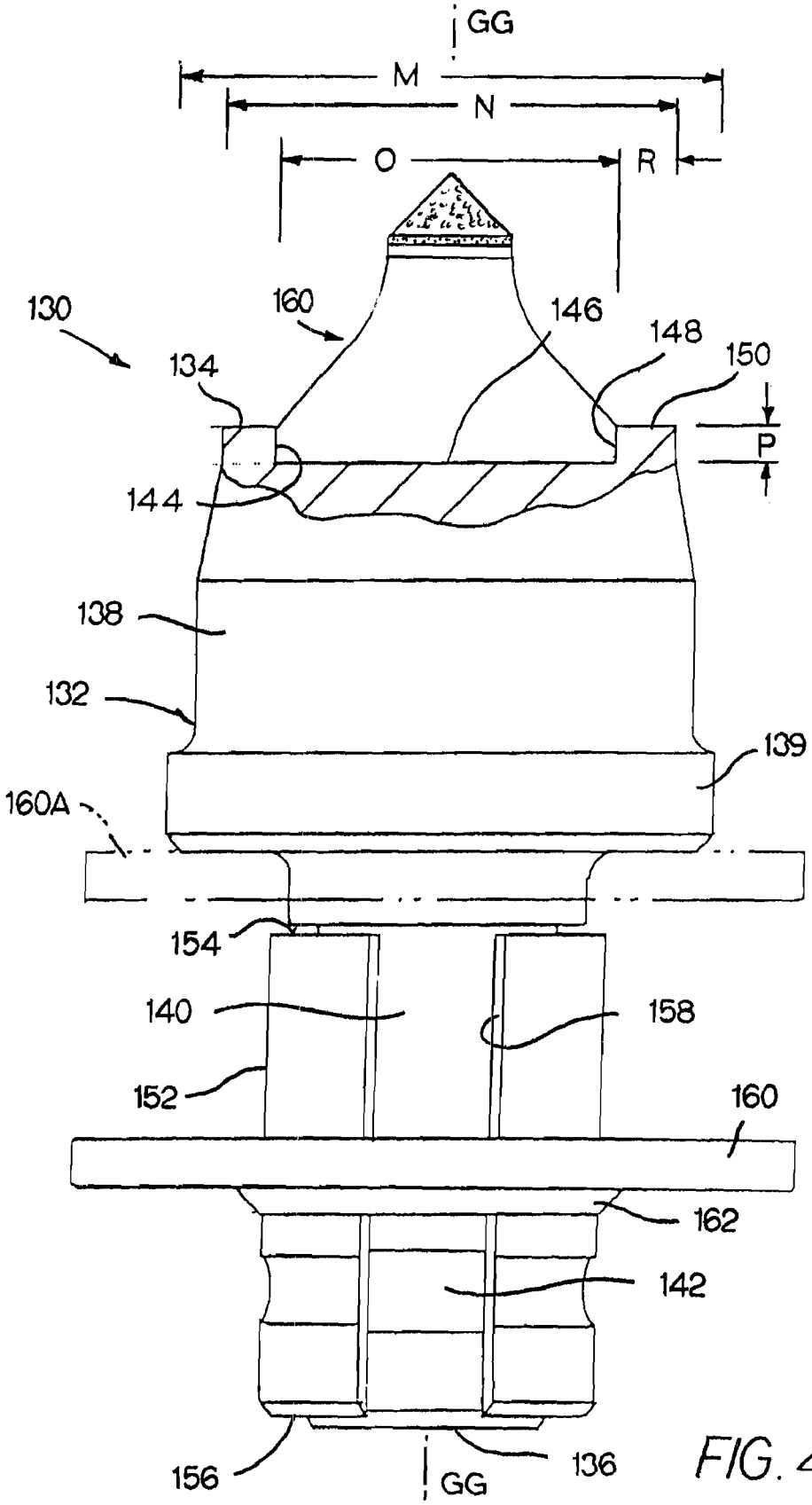
FIG. 4 is a side view of a second specific embodiment of a rotatable cutting tool of the invention wherein the hard cutting member, as well as an axially forward portion of the cutting tool body, are illustrated in cross-section to illustrate the geometry of the entire hard cutting member and of the braze joint between the hard cutting member and the cutting tool body.
Figure 5:
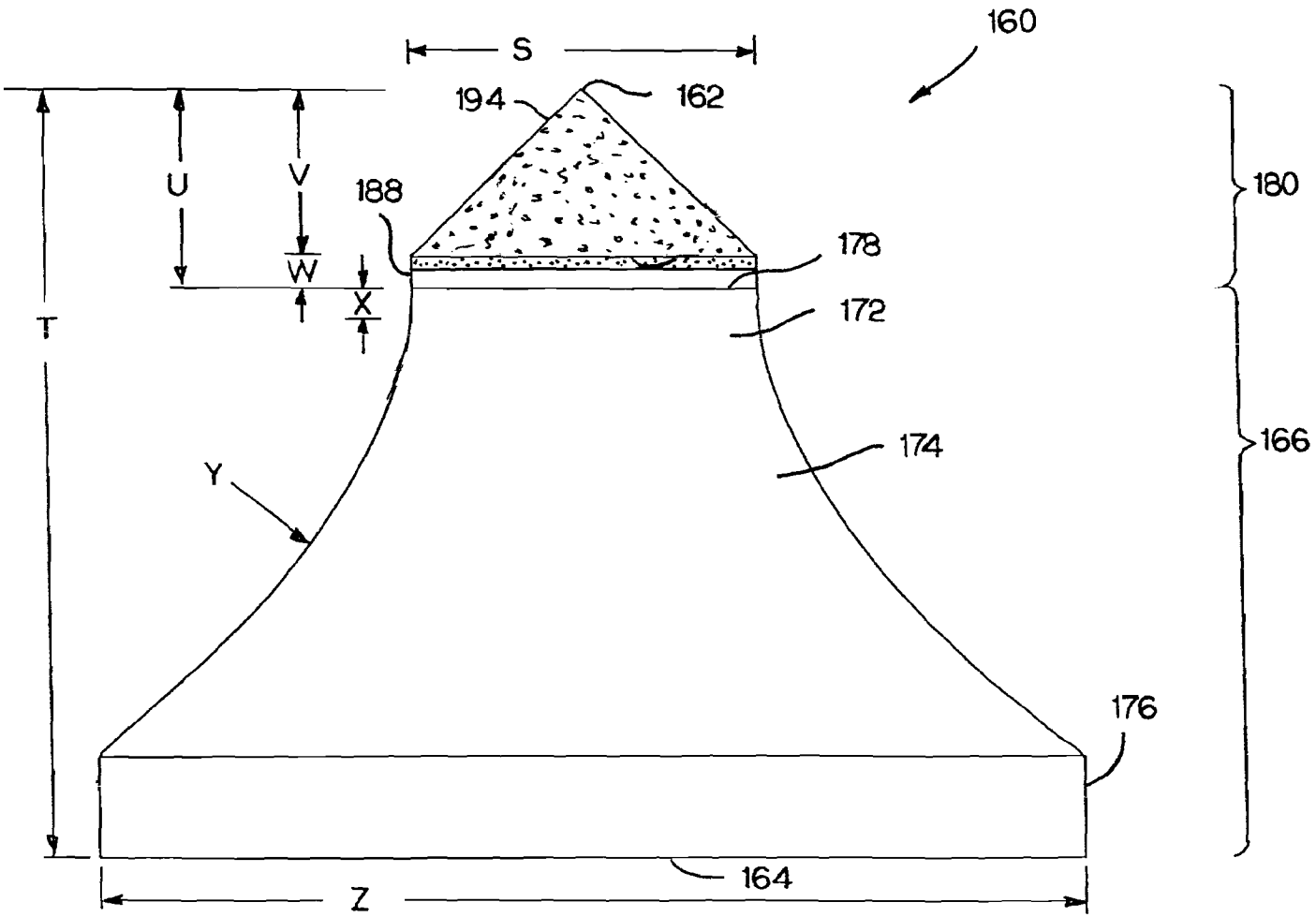
FIG. 5 is a side view of the hard cutting member of FIG. 4 including and illustration of the braze joint between the superhard member and the substrate.

Referring to FIGS. 4 and 5, these drawings illustrate a second specific embodiment of the rotatable cutting tool of the invention, generally designated as 130. Rotatable cutting tool 130 has a central longitudinal axis GG-GG. In operation, rotatable cutting tool 130 rotates about axis GG-GG. Rotatable cutting tool 130 includes an elongate cutting tool body 132, which typically is made of steel. Exemplary compositions of the steel for the cutting tool body 132 are the same as those for elongate cutting tool body 32.

Elongate cutting tool body 132 presents a generally cylindrical geometry, and has an axial forward end 134, which has a transverse dimension "N", and an axial rearward end 136. Elongate cutting tool body 132 includes a head portion 138, which has a maximum transverse dimension of dimension "M" located at collar 139, adjacent the axial forward end 134. Elongate cutting tool body 132 further includes a shank portion 140, which has a reduced transverse dimension, adjacent the axial rearward end 136. The shank portion 140 contains an annular groove 142. The head portion 138 contains a socket 144, which has a diameter of a dimension "O", at the axial forward end of the cutting tool body 132. The socket 144 includes a circular flat surface 146 and an upstanding cylindrical portion 148. Socket 144 has an axial depth of a dimension "P". There is a peripheral face 150 that surrounds the socket 144, which is of a width (or transverse dimension) "R".

The elongate cutting tool body 132 carries an elongate resilient retainer 152. Resilient retainer 152 presents an axial forward end 154 and an axial rearward and 156. Resilient retainer 152 contains a longitudinal slit 158 along the entire longitudinal length thereof. The presence of the slit 158 provides a radial resiliency to the resilient retainer 152. As illustrated by solid lines, a generally circular washer 160, which has a collar 162 extending and an axial rearward direction, surrounds and radially compresses the resilient retainer 152. Although not illustrated, washer 160 contains a central aperture. Washer 160 as illustrated by solid lines is in a condition prior to the insertion of the rotatable cutting tool 130 into the bore of a block or holder. Upon the insertion of the rotatable cutting tool 130 into the bore of a block or holder, the washer 160 is forced in an axial forward direction along the surface of the resilient retainer 152 until it abuts against the rearward surface of the enlarged head portion 138. When in this condition, washer 160A is illustrated in FIG. 4 by dashed lines.

Rotatable cutting tool 130 further includes a hard cutting member, which is generally designated as 160 in FIG. 4, affixed within socket 144 at the axial forward end 134 of the cutting tool body 132. Hard cutting member 160 has an overall axial length of dimension "T" (see FIG. 5). Referring especially to FIG. 5, hard cutting member 160 includes an axial forward end 162 and an axial rearward end 164, which defines a generally circular axial rearward face. Hard cutting member 160 includes a hard axial rearward portion shown by bracket 166. The hard axial rearward portion 166 includes a circular axial forward face 178, as well as a cylindrical region 172 (which has an axial length of a dimension "X"), which is contiguous with a concave region 174, which has a radius of curvature "Y". Concave region 174 is contiguous with an axial rearward base portion 176, which has a maximum diameter of a dimension "Z".

The hard cutting member 160 further includes at the axial forward end thereof a superhard axial forward portion shown by bracket 180. Superhard axial forward portion 180 has an overall axial length of a dimension "U", and a maximum diameter or transverse dimension of a dimension "S". Superhard axial forward portion 180 includes a substrate 188 along the same general lines as the substrate 102 of the superhard axial forward portion 100. In this regard, the substrate 188 has a conical portion and a cylindrical portion. The overall superhard axial forward portion 180 presents a cylindrical section that has an axial length of a dimension "W" and a conical section that has an axial length of a dimension "V". A layer of superhard material 194 is on the surface of the substrate. Skilled artisans know techniques useful to join a polycrystalline diamond member to a substrate. The substrate typically is made from materials such as cemented cobalt tungsten carbide of the same kind used by substrates of the other superhard forward portions. The superhard member is made from superhard materials such as polycrystalline diamonds that are the same as used for superhard members of the other superhard forward portions described herein.

Table II below sets forth the dimensions of the specific embodiment of the rotatable cutting tool 130. By presenting these dimensions, there is no intention to limit the scope of the invention as defined by the claims herein.

TABLE II

| Dimensions for the Second Specific Embodiment of the Rotatable Cutting Bit 130 | | |
|---|---|---|
| Dimension | Description of dimension | Value (inches unless otherwise noted) |
| M | Maximum diameter of the enlarged head portion 138 of the cutting tool body 132 | 1.39 inches at collar 139 (1.25 inches at element 138) |
| N | Maximum diameter of the axial forward end 134 of the cutting tool body 132 | 1.14 |
| O | Maximum diameter of the cylindrical face 176 of the hard cutting member 160 | 0.86 |
| P | Depth of the socket 144 in the cutting tool body 132 | 0.13 |
| R | width of the peripheral face 150 | 0.14 |
| S | Maximum diameter of the superhard forward portion 180 of the hard cutting member 160 | 0.34 |
| T | Entire axial length of the hard cutting member 160 | 0.69 |
| U | Entire axial length of the superhard forward portion 180 of the hard cutting member 160 | 0.20 |
| V | Axial length of the conical section of the superhard axial forward portion 180 | 0.08 |
| W | Axial length of the cylindrical section of the superhard axial forward portion 180 | 0.12 |
| X | Axial length of the cylindrical region 172 of the hard axial rearward portion 166 | 0.50 |
| Y | Radius of curvature of the arcuate/concave region 174 of the hard cutting member 160 | 0.62 |

Figure 6:
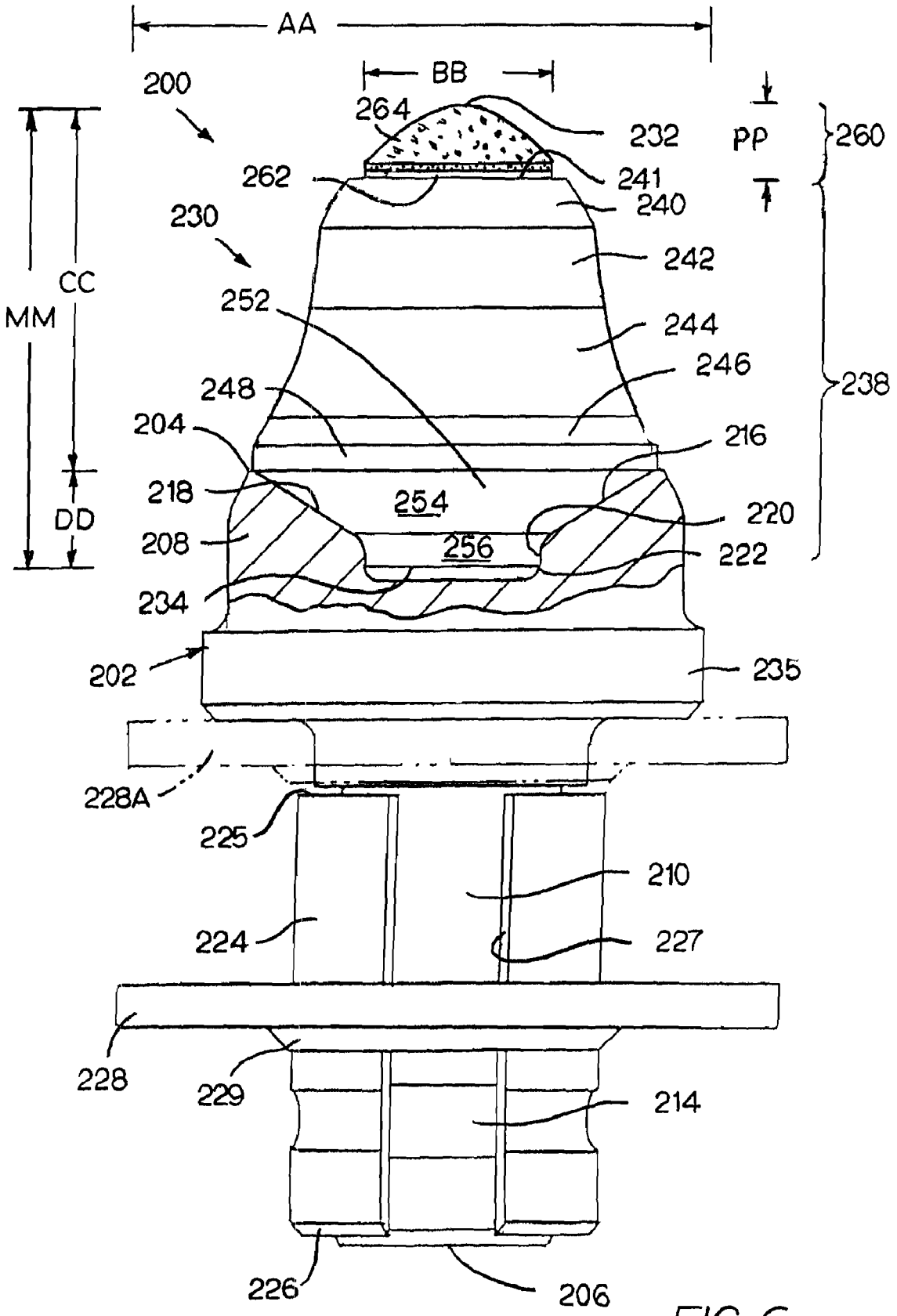
FIG. 6 is a side view of a third specific embodiment of a rotatable cutting tool of the invention wherein the axially forward portion of the cutting tool body is illustrated in cross-section to illustrate the geometry of the entire hard cutting member and of the braze joint between the hard cutting member and the cutting tool body.

Referring to the drawings, FIG. 6 illustrates a third specific embodiment of the rotatable cutting tool of the invention, generally designated as 200. Rotatable cutting tool 200 includes an elongate cutting tool body 202, which typically is made of steel. Exemplary compositions of the steel for the cutting tool body 202 are the same as those for elongate cutting tool body 32. Elongate cutting tool body 202 presents a generally cylindrical geometry, and has an axial forward end 204 and an axial rearward end 206. Elongate cutting tool body 202 includes a head portion 208, which has an enlarged transverse dimension (wherein the maximum dimension is "AA" at collar to 235), adjacent the axial forward end 204. The elongate cutting tool body 202 further has a shank portion 210, which has a reduced transverse dimension, adjacent the axial rearward end 206. The shank portion 210 contains an annular groove 214. The head portion 208 contains a socket 216 at the axial forward end of the cutting tool body 202. The socket 216 includes a frusto-conical portion 218 and a cylindrical portion 220. The socket 216 further contains a bottom surface 222.

The elongate cutting tool body 200 carries an elongate resilient retainer 224. Resilient retainer 224 presents an axial forward end 225 and an axial rearward end 226. Resilient retainer 224 contains a longitudinal slit 227 along the entire longitudinal length thereof. The presence of the slit 227 provides a radial resiliency to the resilient retainer 224. As illustrated by solid lines, a generally circular washer 228, which has a collar 229 extending and an axial rearward direction, surrounds and radially compresses the resilient retainer 224. Although not illustrated, washer 228 contains a central aperture. Washer 228 as illustrated by solid lines is in a condition prior to the insertion of the rotatable cutting tool 200 into the bore of a block or holder. Upon the insertion of the rotatable cutting tool 200 into the bore of a block or holder, the washer 228 is forced in an axial forward direction along the surface of the resilient retainer 228 until it abuts against the rearward surface of the enlarged head portion 208. When in this condition, washer 228A is illustrated in FIG. 6 by dashed lines.

Rotatable cutting tool 200 further includes a hard cutting member generally designated as 230, which has an overall axial length of dimension "MM", affixed within socket 216 at the axial forward end 204 of the cutting tool body 202. The hard cutting member to 230 extends in the axial forward direction a distance "CC" past the axial forward and 204 of the rotatable cutting tool body 202. Hard cutting member 230 includes an axial forward end 232 and an axial rearward end 234.

As illustrated in FIG. 6, hard cutting member 70 includes a hard axial rearward portion shown by bracket 238. The hard axial rearward portion 238 includes an axial forward face 241, as well as five contiguous regions (240, 242, 244, 246, 248) along the axial length of the hard axial rearward portion 238 until reaching the base portion 252. The base portion 252 includes a frusto-conical portion 254 and a contiguous cylindrical portion 256. The base portion 252 has an axial length of a dimension "DD".

The hard cutting member 230 further includes at the axial forward end thereof a superhard axial forward portion shown by bracket 260, which has a maximum diameter of a dimension "BB". Superhard axial forward portion 260 comprises a substrate 262 and a layer of polycrystalline diamond 264 on the substrate 262. The superhard axial forward portion 260 has a cylindrical section and a conical (or dome-shaped) section. The overall axial length of the superhard axial forward portion 260 is a dimension "PP".

Table III below sets forth the dimensions of the specific embodiment of the rotatable cutting tool 30. By presenting these dimensions, there is no intention to limit the scope of the invention as defined by the claims herein.

TABLE III

| Dimensions for the Third Specific Embodiment of the Rotatable Cutting Tool 200 | | |
|---|---|---|
| Dimension | Description of dimension | Value (inches unless otherwise noted) |
| AA | Maximum diameter of the enlarged head portion 208 of the cutting tool body 202 | 1.25 inches at element 208 and 1.39 inches at collar 235 |
| BB | Maximum diameter of the superhard forward portion to 260 of the hard cutting member 230 | 0.45 |
| CC | Axial length of the hard cutting member 239 axially forward of the axial forward end 204 of the cutting tool body | 0.93 |
| DD | Axial length of the base section 252 of the hard cutting member 230 | 0.28 |
| MM | Overall axial length of hard cutting member to 230 | 1.21 |

Comparative tests between rotatable cutting tools along the lines of this first specific embodiment and a conventional rotatable cutting tool were done in a road planing operation. The results showed a significantly higher useful tool life for the rotatable cutting tool along the lines of the first specific embodiment as compared to the conventional rotatable cutting tool.

It thus becomes apparent that the present invention provides an improved rotatable cutting tool, which is rotatably carried by an individual block or holder of a rotatable drum of a cutting machine (e.g., a road planing machine), that experiences an increase, and especially a significant increase, in useful tool life as compared to heretofore known rotatable cutting tools.

It thus becomes apparent that the present invention provides an improved rotatable cutting tool that has a hard cutting member wherein the hard cutting member maintains its integrity longer than hard cutting members in heretofore known rotatable cutting tools. Such a feature results in an increase in useful life of the rotatable cutting tool as compared to heretofore known rotatable cutting tools.

It thus becomes apparent that the present invention provides an improved rotatable cutting tool that presents a braze joint that maintains its integrity longer than braze joints in heretofore known rotatable cutting tools. Such a feature results in an increase in useful life of the rotatable cutting tool as compared to heretofore known rotatable cutting tools.

It thus becomes apparent that the present invention provides an improved rotatable cutting tool that presents a cutting tool body that experiences less "steel wash" as compared to heretofore known rotatable cutting tools. By providing a cutting tool body that experiences less "steel wash", there will be an increase in the useful life of the rotatable cutting tool as compared to heretofore known rotatable cutting tools.

The patents and other documents identified herein are hereby incorporated by reference herein. Other embodiments of the invention will be apparent to those skilled in the art from a consideration of the specification or a practice of the invention disclosed herein. It is intended that the specification and samples are illustrative only and are not intended to be limiting on the scope of the invention. The true scope and spirit of the invention is indicated by the following claims.

What is claimed is:

1. A rotatable cutting tool for impingement upon a substrate and adapted to be rotatably retained within the bore of a holder, the rotatable cutting tool comprising:

an elongate cutting tool body having an axial forward end and an axial rearward end, the cutting tool body containing a socket at the axial forward end thereof;

a hard cutting member being affixed to the cutting tool body within the socket, the hard cutting member having an axial forward end and an axial rearward end, and the hard cutting member having an axial length;

the hard cutting member having a superhard axial forward portion at the axial forward end thereof, and the superhard axial forward portion having a maximum transverse dimension;

the hard cutting member further having a hard axial rearward portion contiguous with and axial rearward of the superhard axial forward portion, and the hard axial rearward portion having a maximum transverse dimension; and a ratio of the maximum transverse dimension of the hard axial rearward portion to the axial length of the hard cutting member ranging between about 0.75 and about 0.85.

2. The rotatable cutting tool according to claim 1 wherein the superhard axial forward portion comprising a substrate and a layer of the superhard material adhered to the substrate.

3. The rotatable cutting tool according to claim 1 wherein the axial forward end of the cutting tool body having a transverse dimension, and the maximum transverse dimension of the hard axial rearward portion being about equal to the transverse dimension of the axial forward end of the cutting tool body.

4. The rotatable cutting tool according to claim 1 wherein the axial forward end of the cutting tool body having a transverse dimension, and the maximum transverse dimension of the hard axial rearward portion being less than the transverse dimension of the axial forward end of the cutting tool body.

5. The rotatable cutting tool according to claim 1 wherein the ratio of the maximum transverse dimension of the hard axial rearward portion to the axial length of the hard cutting member equaling about 0.80.

6. The rotatable cutting tool according to claim 1 wherein the ratio of the maximum transverse dimension of the superhard axial forward portion to the maximum transverse dimension of the hard axial rearward portion ranging between about 0.35 and about 0.45.

* * * * *